US007948461B2

(12) United States Patent
Kageyama et al.

(10) Patent No.: US 7,948,461 B2
(45) Date of Patent: May 24, 2011

(54) IMAGE DISPLAY DEVICE

(75) Inventors: Hiroshi Kageyama, Hachioji (JP); Katsumi Matsumoto, Mobara (JP); Toshio Miyazawa, Chiba (JP)

(73) Assignee: Hitachi Displays, Ltd., Mobabra-shi (JP)

( * ) Notice: Subject to any disclaimer, the term of this patent is extended or adjusted under 35 U.S.C. 154(b) by 1127 days.

(21) Appl. No.: 11/656,428

(22) Filed: Jan. 23, 2007

(65) Prior Publication Data

US 2007/0176875 A1 Aug. 2, 2007

(30) Foreign Application Priority Data

Jan. 27, 2006 (JP) ..... 2006-018500

(51) Int. Cl.
*G09G 3/36* (2006.01)

(52) U.S. Cl. ..... 345/92

(58) Field of Classification Search ..... None
See application file for complete search history.

(56) References Cited

U.S. PATENT DOCUMENTS 6,774,876 B2 * 8/2004 Inukai ..... 345/76
2004/0036702 A1 * 2/2004 Kageyama et al. ..... 345/690

FOREIGN PATENT DOCUMENTS

JP 08-194205 A 7/1996
JP 08-286170 A 11/1996

* cited by examiner

*Primary Examiner* — Alexander Eisen
*Assistant Examiner* — Robin Mishler
(74) *Attorney, Agent, or Firm* — Miles & Stockbridge P.C.

(57) ABSTRACT

The present invention provides an image display device having about the same numbers of gate lines and data lines as before and capable of reducing the power consumption of a static memory during rewriting of a display image. In the configuration of the image display device, the drain electrode of a first transistor 15 included in a pixel circuit is connected to an input for setting a storing state of the static memory, the drain electrode of a second transistor 18 is connected to an input for resetting a storing state of the static memory, the source electrode of the first transistor is connected to a data line, the gate electrode of the first transistor included in a row of pixel circuits arranged parallel to gate lines is connected to one gate line of the plurality of gate lines, and the gate electrode of the second transistor included in another row of pixel circuits arranged adjacent to the row of pixel circuits is connected to the one gate line.

7 Claims, 10 Drawing Sheets

IMAGE DISPLAY DEVICE

CLAIM OF PRIORITY

The present application claims priority from Japanese application JP 2006-018500 filed on Jan. 27, 2006, the content of which is hereby incorporated by reference into this application.

FIELD OF THE INVENTION

The present invention relates to an image display device and a driver circuit thereof, and more particularly to an image display device incorporating a static memory in each pixel circuit and having reduced power consumption.

BACKGROUND OF THE INVENTION

In an active matrix type display, typically an active matrix type liquid crystal display, a thin film transistor (hereinafter abbreviated as TFT) is formed in each pixel, and display information is stored on a pixel-by-pixel basis to display images. A TFT formed by using a polysilicon film which is fabricated by polycrystallization of an amorphous silicon film by laser annealing, with its mobility being raised to about 100 $cm^2/VS$ is called a polysilicon TFT. Since a circuit configured of such polysilicon TFTs operates with signals of a few MHz to dozens of MHz at the maximum, not only pixels but also a data driver circuit generating image signals and a scanning circuit can be formed over the substrate of a liquid crystal display device or the like in the same process as the formation of the TFTs constituting pixel circuits.

A transmissive liquid crystal display performs display by controlling the transmittance of transmitted light of a backlight. On the other hand, a reflective liquid crystal display which has a reflecting electrode for reflecting external light in a pixel performs display by controlling the reflectance of sunlight or room illumination light that comes in pixels, thereby negating the need for a backlight.

Further, a liquid crystal display having both the functions of transmission and reflection is called a semi-transmissive liquid crystal display. In general, the reflective liquid crystal display and the semi-transmissive liquid crystal display in a state where the backlight is not lit feature much lower power consumption compared to the transmissive liquid crystal display which requires the backlight to light up.

Liquid crystal displays enhancing such a low power consumption feature include a liquid crystal display with built-in pixel memory. Since an ordinary liquid crystal display without built-in pixel memory temporarily stores electric charge in a capacitor in a pixel to hold voltage that is applied to the liquid crystal, it is necessary to refresh the voltage at regular time intervals even in the case of displaying a static image. Thus, in either case of displaying a moving image or a static image, data lines for transferring data signals to pixels needs to be driven at about dozens of kHz; therefore, the data lines and the data driver circuit for driving the data lines consume much power.

The liquid crystal display with built-in pixel memory which places emphasis on displaying static images incorporate a static memory in each pixel, thereby negating the need for refresh operation and therefore making it possible to completely cut power consumed by the data lines and the data driver circuit.

FIG. 9 shows the configuration of a conventional display with built-in memory. Pixel circuits 82 are arranged in a matrix form over a glass substrate 81.

In FIG. 9, the pixel circuits 82 are arranged only in two columns by three rows, for simplicity of explanation. However, the actual numbers of columns and rows are both over several hundreds. A pixel circuit 82 is composed of a sampling TFT 83 for sampling data from a data line, a static memory 84 for storing 1 bit of data, and an AC circuit 85 for applying AC voltage corresponding to the storing state of the static memory 84 to a liquid crystal LC as a display section.

Each pixel circuit 82 is connected to data lines s1 to s2 and gate lines g1 to g3 through the sampling TFT 83. The data lines s1 to s2 are connected to a data driver circuit 86, and the gate lines g1 to g3 are connected to a scanning circuit 87. The data driver circuit 86 has the function of temporarily storing video signals serially inputted from the outside of the display and parallelly outputting to the data lines s1 to s2.

The scanning circuit 87 sequentially outputs pulses to the gate lines g1 to g3 in synchronization with the output operation of the data driver circuit 86, thereby determining a horizontal row of pixel circuits 82 for writing a video signal generated on the data lines s1 to s2. The sampling TFT 83 is turned on by a pulse supplied to the connected gate line, thereby writing the signal of the connected data line into the static memory 84.

The AC circuit 85 selects a square wave voltage VLCa or VLCb in accordance with the state of 1-bit data stored in the static memory. The voltage Vcom is a square wave voltage having a frequency of about 30 to 60 Hz, the voltage VLCa is a square wave voltage in phase with Vcom, and the voltage VLCb is a square wave voltage of opposite phase to Vcom. For example, assume that a normally white liquid crystal (in which bright display is performed when the applied AC voltage is small in amplitude) and an optical structure required therefor are employed, for example. When the voltage VLCa is selected, in-phase signals are applied to the liquid crystal LC; therefore, the applied AC voltage becomes low and the liquid crystal cell LC displays white. On the other hand, when the voltage VLCb is selected, opposite-phase signals are applied to the liquid crystal LC; therefore, the applied AC voltage becomes high and the liquid crystal cell LC displays black. The liquid crystal display device with built-in memory is described in more detail in JP-A-8-194205 (194205/1996) and JP-A-8-286170 (286170/1996).

In accordance with the state of 1-bit data stored in the static memory 84, the white display or black display of each pixel can be selected. Accordingly, in the case where video data is not rewritten, it is possible to display a static image even if the operation of the data driver circuit 86 and the scanning circuit 87 is stopped. Since this makes it possible to cut all the power for driving the data lines s1 to s2 and the gate lines g1 to g3, the display with built-in memory can reduce power consumption during static image display, compared to an ordinary liquid crystal display.

SUMMARY OF THE INVENTION

However, even the liquid crystal display with built-in pixel memory needs to drive the data driver circuit 86 and the scanning circuit 87 in the case of rewriting a static image; therefore, it is important to reduce power during rewriting.

In FIG. 9, when the sampling TFT 83 rewrites the storing state of the static memory 84, the current supply capacity of the sampling TFT 83 in writing a low level voltage of the data line differs from that in writing a high level voltage of the data line. In order to rewrite the storing state of the static memory 84, it is necessary that the supply current of the sampling TFT 83 is sufficiently larger than the driving current of TFTs constituting the static memory 84.

FIG. 10A is an illustration showing a sink current $I_{sink}$ flowing through the sampling TFT in the case where the sampling TFT supplies the low level potential of the data line to the static memory to rewrite the storing state. Since FIG. 10A is an illustration for explaining a general principle, the sampling TFT is represented by symbol Ts and the static memory is represented by symbol Mem. FIG. 11A is a graph showing the operating point of the sink current $I_{sink}$ and a voltage Va generated at the signal input portion of the static memory Mem in FIG. 10A. In FIGS. 11A and 11B, $I_{Mem}$ denotes the supply current of the static memory Mem, and $I_{TS}$ denotes the supply current of the sampling TFT Ts. Further, H denotes a high level, and L denotes a low level.

As shown in FIG. 11A, by way of example, the supply current of the sampling TFT Ts is twice as large as the driving current of TFTs constituting the static memory Mem. In this case, since the gate-source voltage which affects the current supply capacity of the sampling TFT Ts is the difference voltage between the data line and the gate line connected, the sampling TFT has relatively large current supply capacity so that the voltage Va at the operating point is low enough (a left-of-center position on the graph). Since the voltage Va at the operating point is recognized as the low level voltage, the static memory Mem can store the low level voltage of the data line.

On the other hand, in the case where the sampling TFT supplies the high level potential of the data line to the static memory to rewrite the storing state, the sampling TFT flows a source current $I_{source}$ as shown in FIG. 10B. Since FIG. 10B is also an illustration for explaining a general principle, the sampling TFT is represented by symbol Ts and the static memory is represented by symbol Mem. FIG. 11B is a graph showing the operating point OP of the source current $I_{source}$ and a voltage Va generated at the signal input portion of the static memory Mem in FIG. 10B. As shown in FIG. 11B as well, by way of example, the supply current of the sampling TFT Ts is twice as large as the driving current of TFTs constituting the static memory. In this case, since the gate-source voltage which affects the current supply capacity of the sampling TFT Ts is the difference voltage between the voltage Va and the gate line voltage, the current supply capacity decreases sharply as the voltage Va increases, thus making it difficult to increase the voltage Va of the operating point OP (bring the operating point to a right-of-center position on the graph). If the voltage Va of the operating point OP does not become high enough, the static memory Mem may not recognize the voltage Va of the operating point as the high level voltage and therefore may fail to store the high level voltage of the data line.

In order to avoid this problem, the high level voltage of the gate line needs to be higher than the power supply voltage VDD of the static memory Mem. Generating a voltage higher than the power supply voltage VDD requires an additional circuit such as a DC-DC converter, which leads to an increase in the power consumption of the entire image display device.

In order to avoid this problem without increasing the power consumption, the pixel circuit is configured not to rewrite the static memory Mem under the condition of FIG. 10B, but to rewrite the static memory Mem only under the condition of FIG. 10A.

For example, as shown in FIG. 12, it is known that the sampling TFT is configured as a CMOS analog switch having an n-channel TFT 95 and a p-channel TFT 96. A sufficient current is supplied to the static memory Mem through the n-channel TFT 95 at the time of writing a low potential or through the p-channel TFT 96 at the time of writing a high potential. However, this method requires two kinds of different gate lines which are a gate line G for driving the n-channel TFT 95 and a gate line Gz for driving the p-channel TFT 96, thus doubling the number of gate lines in the entire image display device.

Further, as shown in FIG. 13, there is a method for writing signal voltages of complementary logic (in which a high level voltage is provided at one end while a low level voltage is provided at the other end) to the two complementary signal input portions of the static memory through sampling TFTs 97 and 98 of two n-channel TFTs. However, this method requires two kinds of different data lines S and Sz for supplying complementary logic signals, thus doubling the number of data lines in the entire image display device.

Such a significant increase in the number of gate lines or data lines causes the adverse effect of reducing manufacturing yield and lowering the upper limit of the definition of the image display device. Further, as the number of lines is increased, the parasitic capacitance of the lines increases proportionally, so that the power consumption of the data driver circuit or the scanning circuit for driving the lines increases unpreferably.

Accordingly, it is an object of the present invention to provide an image display device for rewriting the static memory Mem only under the condition of FIG. 10A with a simple wiring structure requiring little increase in the number of gate lines or data lines compared to a conventional liquid crystal display device.

A representative aspect of the invention disclosed in this specification will be briefly described as follows. The invention provides an image display device comprising a plurality of pixel circuits arranged in a matrix form over a substrate and each including at least one static memory; a plurality of data lines for conveying an image signal to the plurality of pixel circuits; a plurality of gate lines, intersecting the data lines, for conveying a scanning pulse to the plurality of pixel circuits; and a scanning circuit for sequentially supplying a scanning pulse to the plurality of gate lines, wherein the pixel circuits includes a first transistor for setting a storing state of the static memory and a second transistor for resetting a storing state of the static memory, a drain electrode of the first transistor is connected to an input for setting a storing state of the static memory, a drain electrode of the second transistor is connected to an input for resetting a storing state of the static memory, a source electrode of the first transistor is connected to one of the data lines, a gate electrode of the first transistor included in a row of pixel circuits arranged parallel to the gate lines is connected to one gate line of the plurality of the gate lines, and a gate electrode of the second transistor included in another row of pixel circuits arranged adjacent to the row of pixel circuits is connected to the one gate line.

According to the aspect of the invention, it is possible to reduce power consumption required to rewrite pixel circuits and therefore lower the power consumption of an image display device. Particularly in an image display device, such as a reflective liquid crystal display device or a semi-transmissive liquid crystal display device, in which most of the operating power is consumed for circuit operation, it is easy to obtain the effect of reducing power consumption. Further, it is possible to reduce the power consumption of an electronic device equipped with an image display device according to the invention and thereby obtain the effect of prolonging the operating time of an attached battery.

DETAILED DESCRIPTION OF THE PREFERRED EMBODIMENTS

Preferred embodiments of an image display device according to the present invention will be described with reference to the accompanying drawings.

Figure 1:
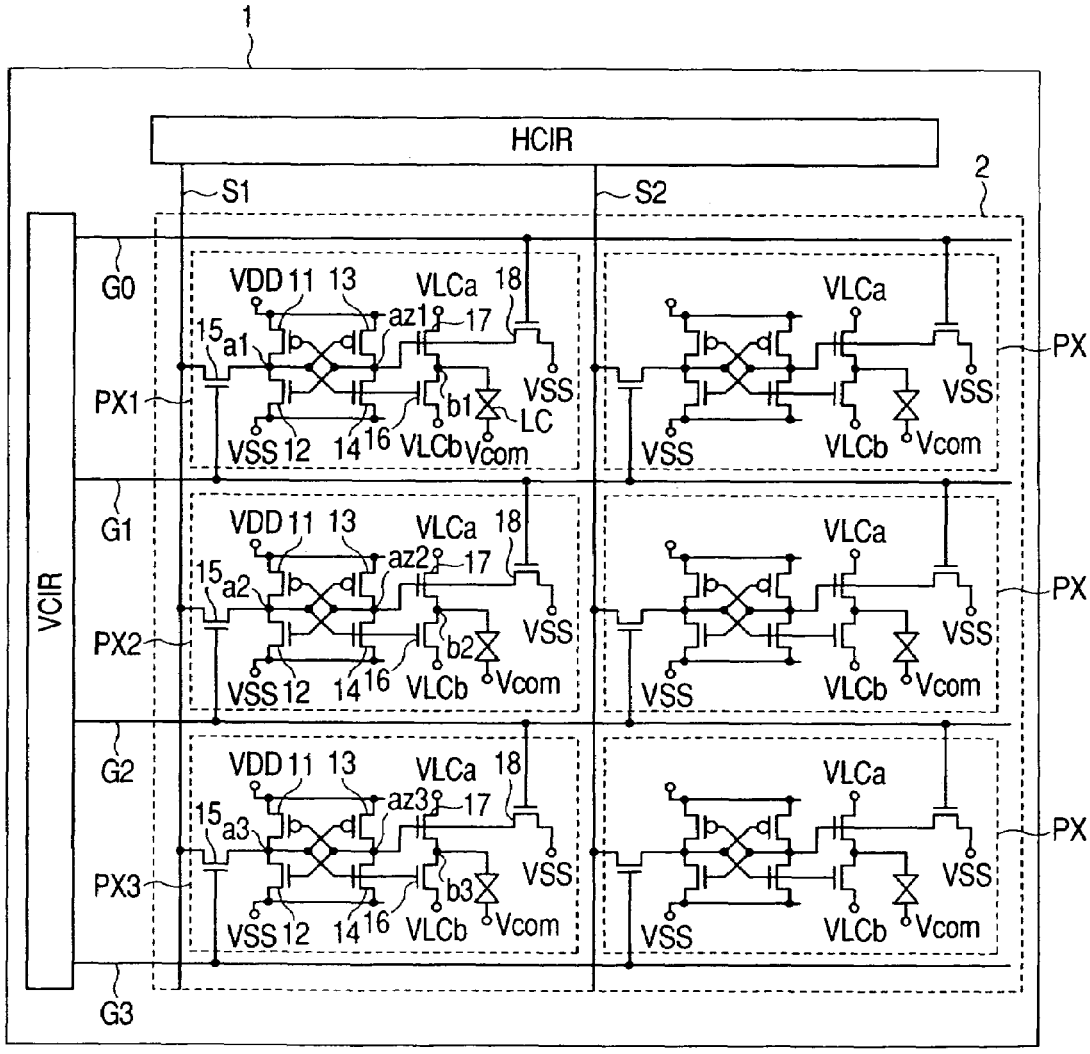
FIG. 1 is an illustration showing the circuit configuration of an image display device according to the present invention.

FIG. 1 shows the circuit configuration of the image display device according to the invention. There are formed over a glass substrate 1 a data driver circuit HCIR, a scanning circuit VCIR, and a display area 2. The glass substrate 1 is a substrate that is generally used in a low-temperature polysilicon manufacturing process. However, the material of the substrate is not limited to glass as long as insulation on the surface is secured. On the display area 2, a plurality of data lines S1 to S2 are wired in vertical directions and a plurality of gate lines G0 to G3 are wired in horizontal directions. Pixel circuits PX and PX1 to PX3 are disposed at intersections. The pixel circuits PX1 to PX3 are the same as the pixel circuits PX; however, they are indicated as PX1 to PX3 for identification in later description.

Figure 9:
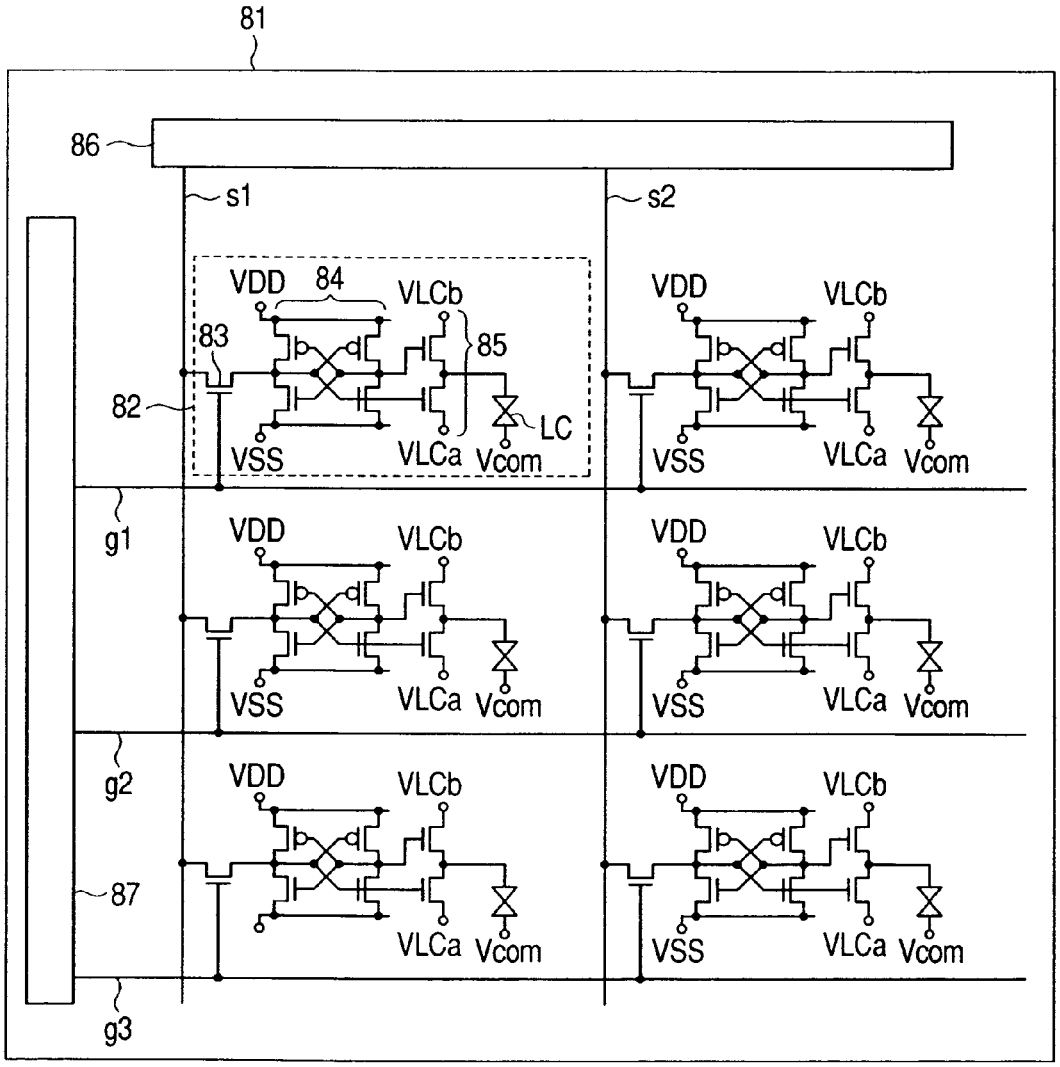
FIG. 9 is an illustration showing the configuration of a conventional display with built-in memory.

In FIG. 1, the number of data lines is 2, the number of gate lines is 4, and the number of pixel circuits PX is 6 (=3×2), for simplicity of explanation. However, in an actual image display device, both the numbers of data and gate lines are over several hundreds. For example, in the case of a color image display device with VGA resolution, the number of data lines is 1920 (=640×3(RGB)), the number of gate lines is 481, and the number of pixel circuits PX is 921600 (=640×3×480). That is, the number of data lines is equal to the number of pixel circuits in the horizontal direction, and therefore equal to the number of data lines in a conventional image display device. The number of gate lines is equal to the number of pixel circuits in the vertical direction plus one, and therefore nearly equal to the number of gate lines in the conventional image display device shown in FIG. 9.

A pixel circuit PX is composed of eight TFTs, which are TFTs 11 to 14 constituting a static memory, a TFT 15 constituting a sampling switch, TFTs 16 and 17 constituting a selector circuit for selecting an AC voltage, and a TFT 18 constituting a reset switch for resetting the state of the static memory. The TFTs 12 and 14 to 18 are n-channel TFTs, and the TFTs 11 and 13 are p-channel TFTs.

It can also be considered that the static memory is composed of two inverters, which are an inverter having an input node az1 (az2, or az3) and an output node a1 (a2, or a3) composed of the TFTs 11 and 12, and an inverter having an input node a1 (a2, or a3) and an output node aZ1 (aZ2, or aZ3) composed of the TFTs 13 and 14.

Thereby, the static memory has two stable states (bi-stable) in which the node az1 is at a low level voltage when the node a1 is at a high level voltage or the node az1 is at a high level voltage when the node a1 is at a low level voltage, and therefore can store 1 bit of information. The TFT 15 constituting the sampling switch is connected at its source electrode to the data line S1 (or S2), connected at its drain electrode to the node a1 (a2, or a3), and connected at its gate electrode to the gate line G1 (G2, or G3).

The TFT 18 constituting the reset switch is connected at its source electrode to the wiring of a negative power supply voltage VSS, connected at its drain electrode to the node az1 (az2, or az3), and connected at its gate electrode to the gate line G0 (G1, or G2). The source electrodes of the TFTs 11 and 13 are connected to the wiring of a positive power supply voltage VDD for operating the static memory circuit, and the source electrodes of the TFTs 12 and 14 are connected to the wiring of a negative power supply voltage VSS for operating the static memory circuit.

A liquid crystal cell LC has a pair of electrodes. One electrode is common to all pixels and is supplied with an AC square wave voltage Vcom. The other electrode which is a node b1 (b2, or b3) is connected to the drain electrodes of the TFTs 16 and 17 constituting the selector circuit. The gate electrodes of the TFTs 16 and 17 are connected to the node a1 (a2, or a3) and to the node az1 (az2, or az3), respectively. The source electrodes of the TFTs 16 and 17 are connected to the wiring of an AC square wave voltage VLCb of opposite phase to the AC square wave voltage Vcom and to the wiring of an AC square wave voltage VLCa in phase with the AC square wave voltage Vcom, respectively.

With this connection, the selector circuit composed of the TFTs 16 and 17 have the function of selecting the AC square wave voltage VLCa or VLCb in accordance with the state of 1-bit data stored in the static memory circuit and supplying it to the liquid crystal cell LC.

Figure 2:
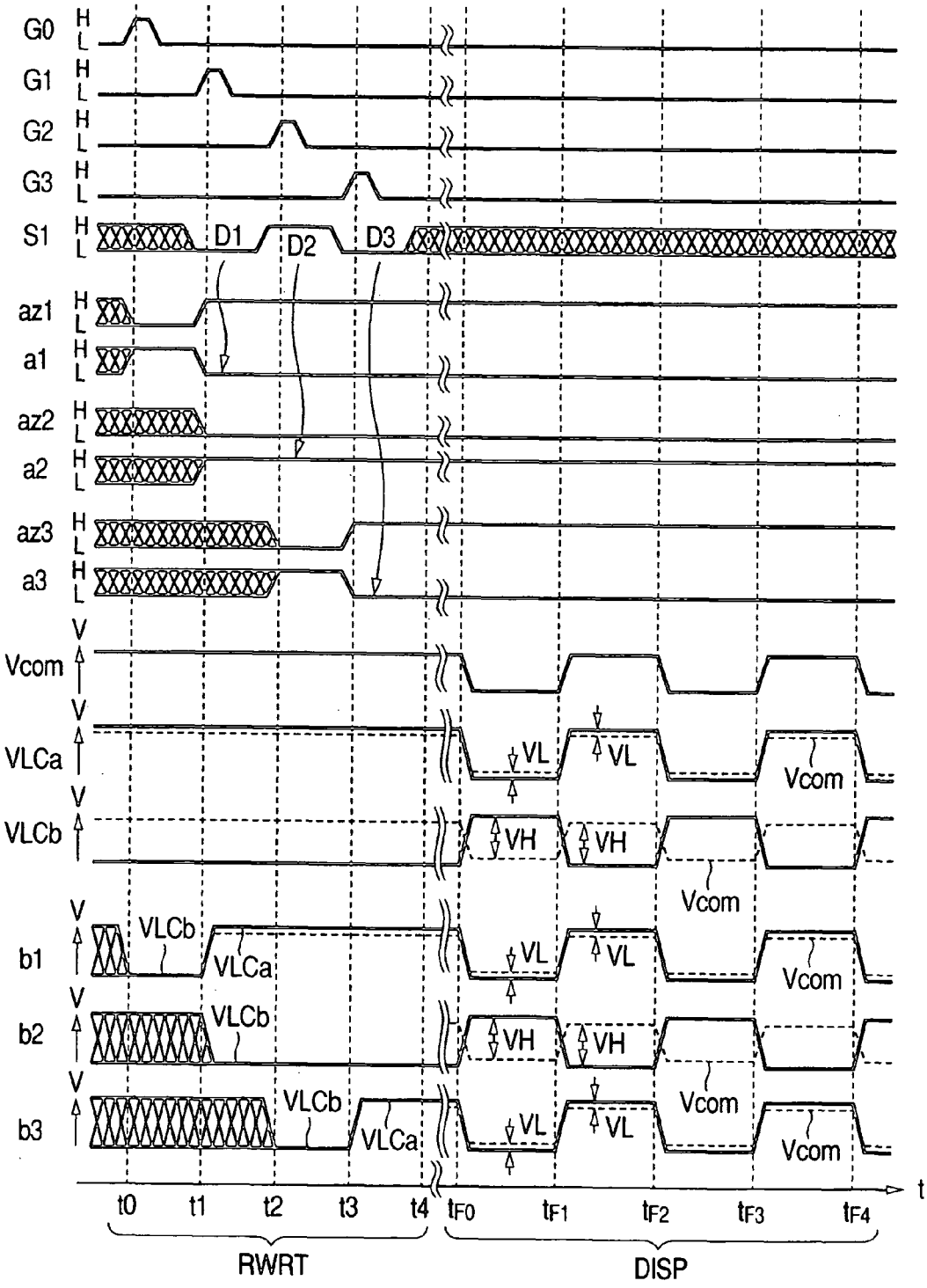
FIG. 2 is a timing chart of voltage waveforms supplied to pixel circuits PX and generated at the pixel circuits PX.

FIG. 2 is a timing chart of voltage waveforms supplied to pixel circuits PX and generated at the pixel circuits PX for the specific explanation of the operation of the pixel circuits PX. In FIG. 2, there are shown only the waveforms related to the three pixel circuits PX1 to PX4 which are connected to the data line S1. A timing chart when the pixel circuits PX perform data rewriting operation (RWRT) is shown at times t0 to t4, and a timing chart when the pixel circuits PX perform static image display (DISP) is shown at times tF0 to tF4. In FIG. 2, in order to make the timing chart easy to see, the length of the period from t0 to t4 is approximately the same as the length of the period from tF0 to tF4. However, in reality, the time period from t0 to t4 is much shorter (e.g., less than a few microseconds) than the response time of the liquid crystal cell. The time period from tF0 to tF4 is approximately the same as or larger than the response time of the liquid crystal cell and, for example, is about a few tens of milliseconds. Thus, in reality, the scales differ by about four orders of magnitude.

In FIG. 2, reference numerals G0 to G3 denote voltage signals supplied to the gate lines G0 to G3; S1, a voltage signal supplied to the data line S1; a1 to a3 and a1Z to a3z, voltage waveforms generated at the nodes a1 to a3 and the nodes az1 to az3; Vcom, VLCa, and VLCb, voltage waveforms of the supplied AC square wave signals; and b1 to b3, voltage waveforms generated at the nodes b1 to b3. The double hatched areas in the signal supplied to the data line S1 signify that either a low level voltage or a high level voltage may appear. The double hatched areas in the voltage waveforms generated at the nodes a1 to a3, az1 to az3, and b1 to b3 signify an undetermined state because of dependence on the state prior to the rewriting operation. Symbols H and L denote a high level voltage and a low level voltage, and symbols V and t denote a voltage and time.

Hereinafter, the data rewriting operation performed by the pixel circuits PX will be described. The gate lines G0, G1, G2, and G3 are supplied with a positive pulse at times t0, t1, t2, and t3, respectively. The data line is supplied with voltages D1, D2, and D3 corresponding to display image information at times t1, t2, and t3, respectively. In FIG. 2, by way of example, D1 and D3 are shown as signals of the low level voltage, and D2 is shown as a signal of the high level voltage. However, in reality, the low level voltage and the high level voltage may change places in accordance with display image information. By configuring the scanning circuit VCIR shown in FIG. 1 with a shift register circuit, the waveforms of the gate lines G0 to G3 can be easily generated. Further, by configuring the data driver circuit HCIR shown in FIG. 1 with a shift register circuit and a latch circuit, externally inputted image information can be easily outputted to the data lines S1 to S2.

When a pulse is supplied to the gate line G0 at time t0, the TFT 18 of the pixel circuit PX1 is turned on. At this time, the TFT 18 is under the condition of FIG. 10A for generating a sink current $I_{sync}$, so that it easily turns the node az1 to the low level voltage. Accordingly, the inverter composed of the TFTs 11 and 12 of the pixel circuit PX1 turns the node a1 to the high level voltage.

When a pulse is supplied to the gate line G1 at time t1, the TFT 15 of the pixel circuit PX1 and the TFT 18 of the pixel circuit PX2 are turned on. The data line S1 is supplied with the low level voltage. Since the TFT 15 of the pixel circuit PX1 is under the condition of FIG. 10A for generating the sink current $I_{sync}$, it easily turns the node a1 to the low level voltage. Accordingly, the inverter composed of the TFTs 13 and 14 of the pixel circuit PX1 turns the node az1 to the high level voltage. The high level voltage at the node az1 turns on the TFT 17, so that the AC square wave voltage VLCa is outputted to the node b1. Since the TFT 18 of the pixel circuit PX2 is under the condition of FIG. 10A for generating the sink current $I_{sync}$, it easily turns the node az2 to the low level voltage. Accordingly, the inverter composed of the TFTs 11 and 12 of the pixel circuit PX2 turns the node a2 to the high level voltage.

When a pulse is supplied to the gate line G2 at time t2, the TFT 15 of the pixel circuit PX2 and the TFT 18 of the pixel circuit PX3 are turned on. The data line S1 is supplied with the high level voltage. Even though the TFT 15 of the pixel circuit PX2 is turned on, since both the data line S1 and the node a2 are at the high level voltage, no current flows through the TFT 15 so that the node a2 maintains the high level voltage. Accordingly, the inverter composed of the TFTs 13 and 14 of the pixel circuit PX2 allows the node az2 to maintain the low level voltage. The high level voltage at the node a2 turns on the TFT 16, so that the AC square wave voltage VLCb is outputted to the node b2. Since the TFT 18 of the pixel circuit PX3 is under the condition of FIG. 10A for generating the sink current $I_{sync}$, it easily turns the node az3 to the low level voltage. Accordingly, the inverter composed of the TFTs 11 and 12 of the pixel circuit PX3 turns the node a3 to the high level voltage.

When a pulse is supplied to the gate line G3 at time t3, the TFT 15 of the pixel circuit PX3 is turned on. The data line S1 is supplied with the low level voltage. Since the TFT 15 of the pixel circuit PX3 is under the condition of FIG. 10A for generating the sink current $I_{sync}$, it easily turns the node a3 to the low level voltage. Accordingly, the inverter composed of the TFTs 13 and 14 of the pixel circuit PX3 turns the node az3 to the high level voltage. The high level voltage at the node az3 turns on the TFT 17, so that the AC square wave voltage VLCa is outputted to the node b3.

Figure 10A:
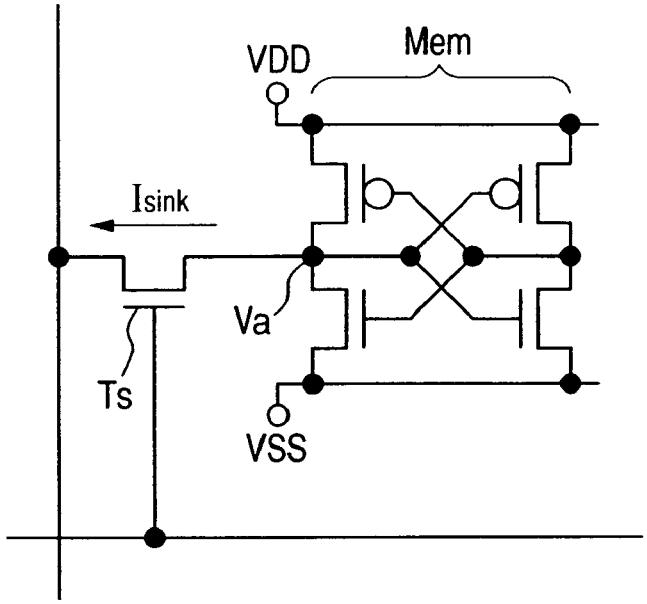
FIG. 10A is an illustration showing a sink current $I_{sink}$ flowing through a sampling TFT.
Figure 10B:
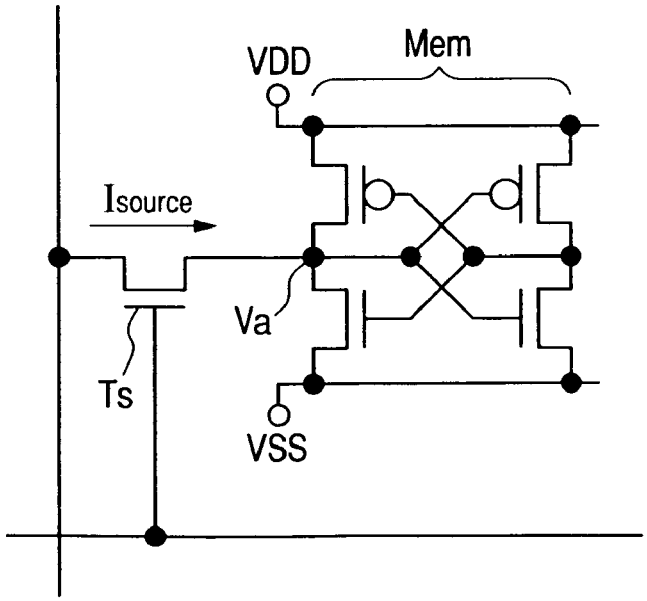
FIG. 10B is an illustration showing a source current $I_{source}$ flowing through a sampling TFT.
Figure 11A:
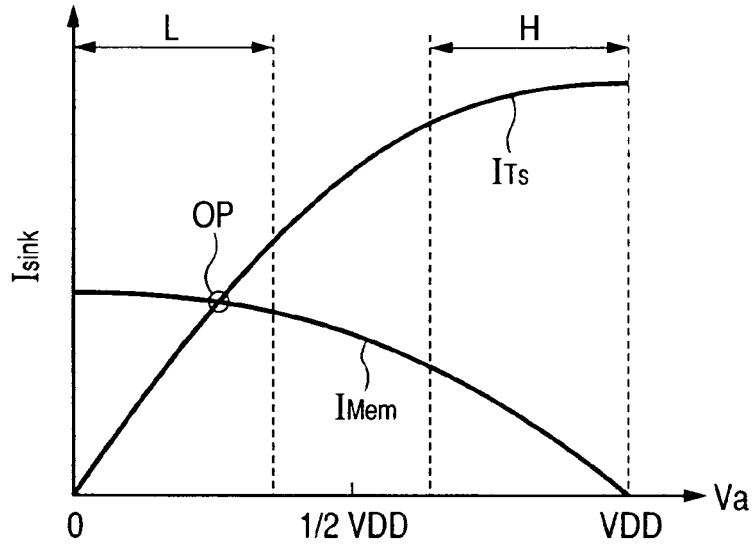
FIG. 11A is a graph showing the operating point of the sink current $I_{sink}$ and a voltage Va in FIG. 10A.
Figure 11B:
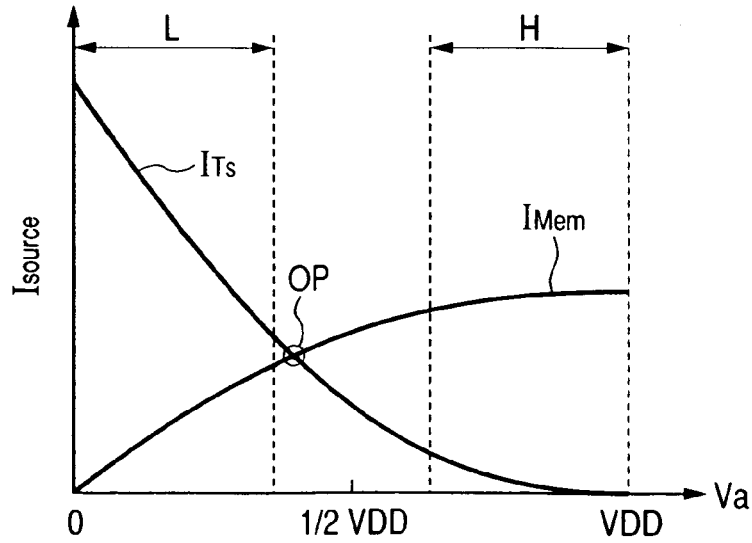
FIG. 11B is a graph showing the operating point of the source current $I_{source}$ and a voltage Va in FIG. 10B.
Figure 12:
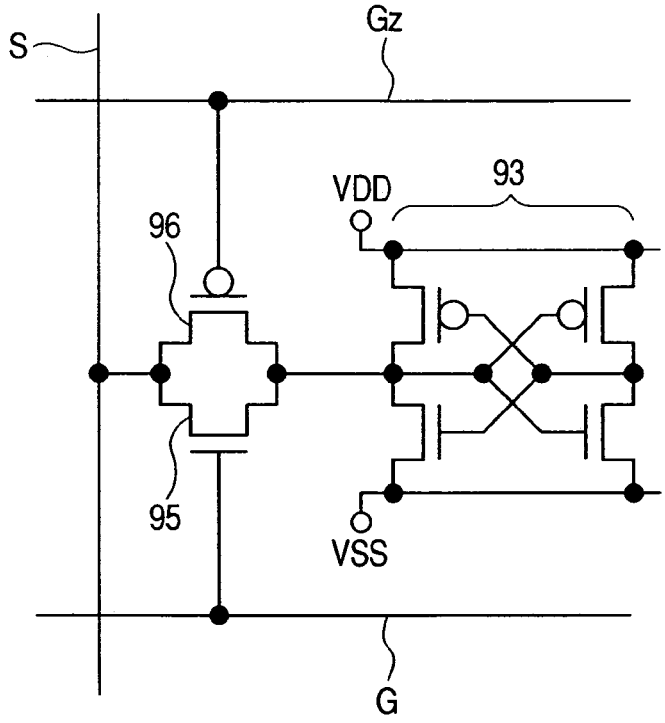
FIG. 12 is an illustration showing the configuration of a conventional pixel circuit.
Figure 13:
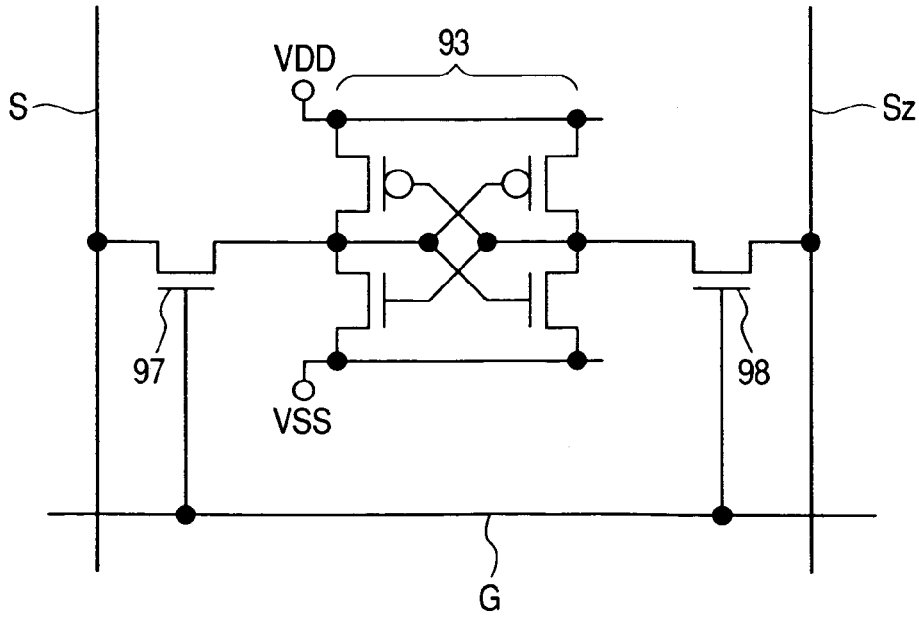
FIG. 13 is an illustration showing the configuration of another conventional pixel circuit.

As described above, data in the pixel circuits is rewritten only under the condition of FIG. 10A, but is not rewritten under the condition of FIG. 10B; therefore, the high level voltage of the gate lines can be much the same as the power supply voltage of the pixel circuits, thus making it possible to reduce power required for the rewriting operation.

Next, description will be made of the operation in which the pixel circuits PX display a static image. The voltage Vcom supplied to the common electrode of the liquid crystal cells LC is an AC square wave voltage whose polarity reverses every one frame period (tF0-tF1, tF1-tF2, tF2-tF3, tF3-tF4). The voltage VLCa is an AC square wave voltage in phase with Vcom, and the voltage VLCb is an AC square wave voltage of opposite phase to Vcom. No signal is sent to the gate lines G0 to G3 and the data lines S1 to S2 suspended.

In the pixel circuits PX1 and PX3 in which the signals D1 and D3 of the low level voltage are written during the rewriting period, since the AC square wave voltage VLCa is generated at the nodes b1 and b3, the amplitude of the AC voltage applied to the liquid crystal cell LC becomes a relatively low voltage VL. On the other hand, in the pixel circuit PX2 in which the signal D2 of the high level voltage is written during the rewriting period, since the AC square wave voltage VLCb is generated at the node b2, the amplitude of the AC voltage applied to the liquid crystal cell LC becomes a relatively high voltage VH.

Figure 3:
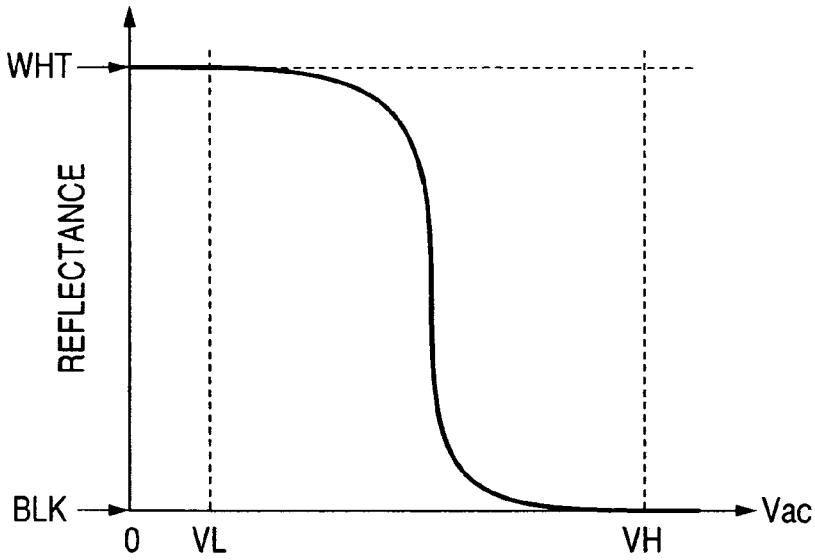
FIG. 3 is a graph showing a general relationship between AC voltage amplitude applied to a liquid crystal cell LC and light reflectance (or transmittance)

FIG. 3 shows a general relationship between AC voltage amplitude applied to a liquid crystal cell LC and light reflectance (or transmittance). In this example, the liquid crystal cell LC is a normally white liquid crystal in which the light reflectance (or transmittance) becomes the maximum when the applied AC voltage amplitude Vac is zero. According to FIG. 3, in the pixel circuits PX1 and PX3 in which the relatively low voltage VL is applied to the liquid crystal cell LC, the reflectance becomes high so that white (WHT) is displayed. In the pixel circuit PX2 in which the relatively high voltage VH is applied to the liquid crystal cell LC, the reflectance becomes low so that black (BLK) is displayed.

Consequently, the pixel circuit in which the low level voltage is written during the rewriting period can maintain the white display during the display period, and the pixel circuit in which the high level voltage is written during the rewriting period can maintain the black display during the display period.

Therefore, the circuit according to this embodiment of the invention shown in FIG. 1 stores static-image data supplied from the data driver circuit HCIR into the pixel circuits PX, and thereby can continue to display the static image for a long time even while no signal is supplied to the gate lines or the data lines.

Figure 4:
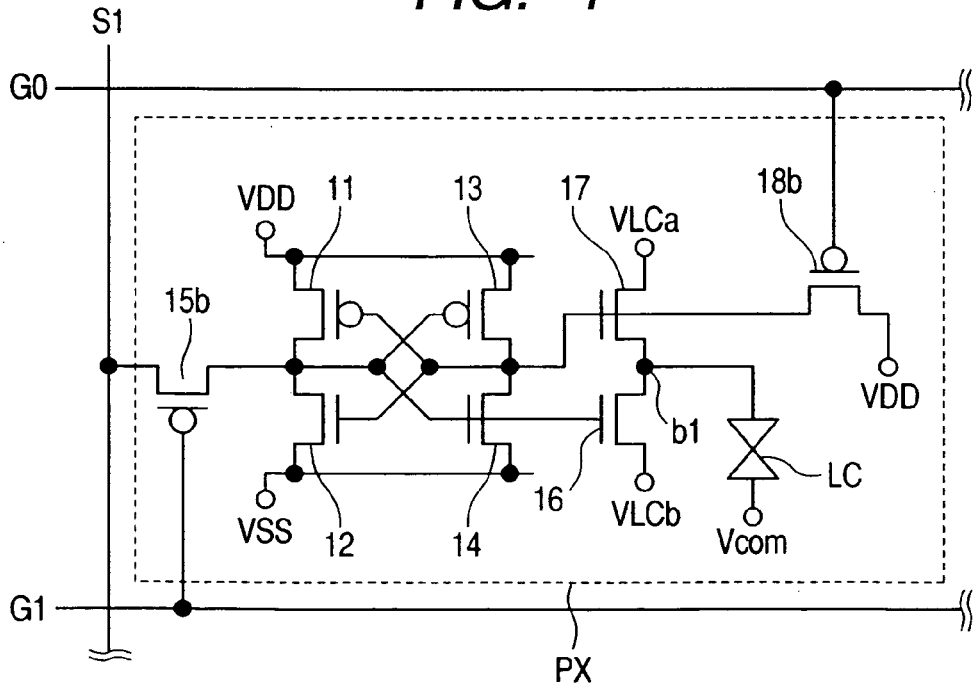
FIG. 4 is an illustration showing another configuration of a pixel circuit PX.

FIG. 4 shows another configuration of the pixel circuit PX. In comparison with the pixel circuit PX shown in FIG. 1, the n-channel TFT 15 constituting the sampling switch and the n-channel TFT 18 constituting the reset switch are replaced with a p-channel TFT 15*b* and a p-channel TFT 18*b*. Further, the source electrode of the TFT 18*b* is connected to the wiring of the positive power supply voltage VDD. When the pixel circuit PX shown in FIG. 4 is supplied with waveforms obtained by reversing the high level voltage and the low level voltage of the gate lines G0 to G3 and the data lines S1 to S2 in the supply waveforms shown in FIG. 2, it is possible to operate in the same way as the pixel circuit PX shown in FIG. 1.

Figure 5:
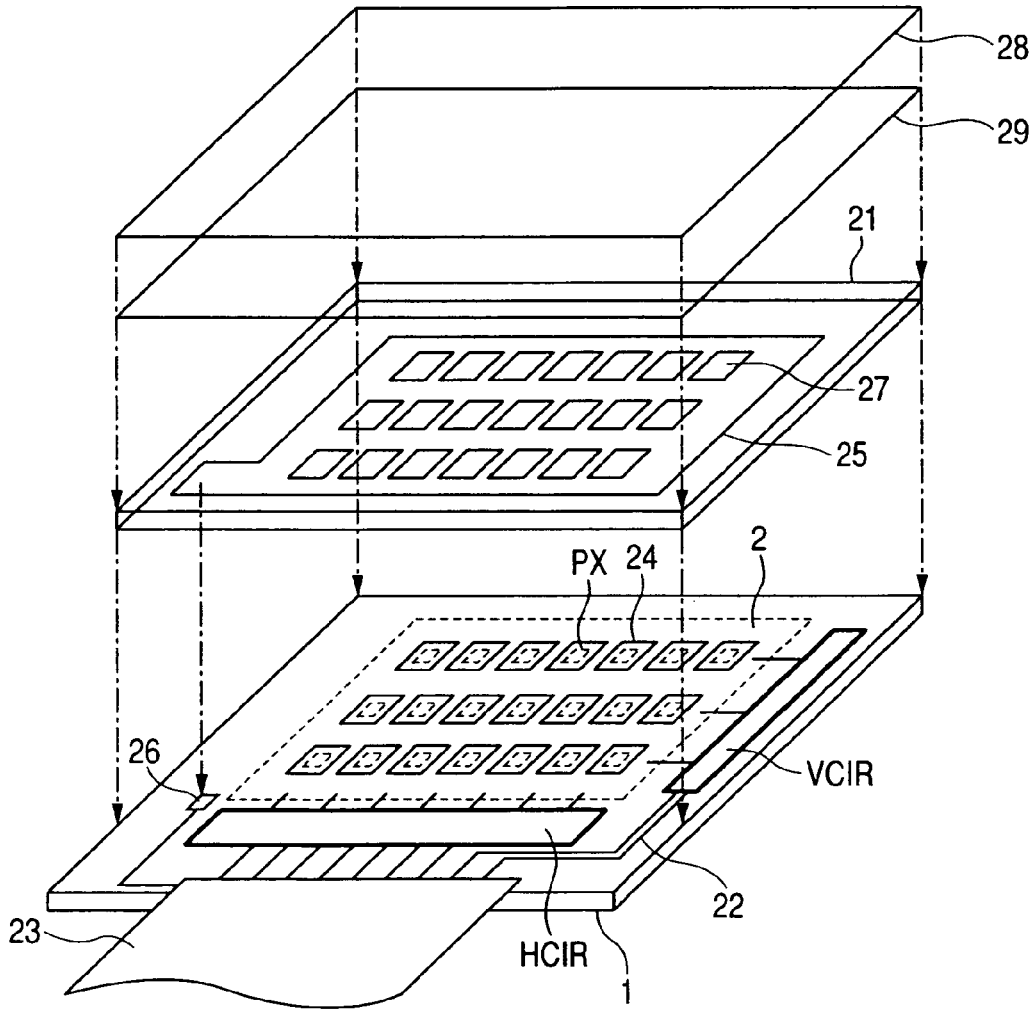
FIG. 5 is an illustration showing the structure of the image display device according to the invention.

FIG. 5 is an exploded perspective view of the structure of the image display device according to the invention. There are formed over the surface of the glass substrate 1, the data driver circuit HCIR formed with TFTs, the scanning circuit VCIR, and the display area 2 where pixel circuits PX are arranged in a matrix form. A film-like circuit board 23 (FPC: Flexible Printed Circuit) is attached to the glass substrate 1, and external voltage signals and voltages required to drive circuits are supplied through the film-like circuit board 23.

Wiring 22 for connecting between the film-like circuit board 23, the data driver circuit HCIR, the scanning circuit VCIR, and the display area 2 is formed using a metal wiring layer used in a TFT forming process. Display electrodes 24 are formed overlapping each pixel circuit PX, and a display electrode 24 is connected to the node b1 (b2, or b3) in the pixel circuit PX shown in FIG. 1.

The glass substrate 1 and the other glass substrate 21 are bonded together with a several-μm thick liquid crystal (not shown) between them. The thickness of the liquid crystal can be maintained uniformly by distributing globular beads (not shown) over the glass substrate 1. There is formed a transparent electrode 25 on the inside surface of the glass substrate 21. The liquid crystal is held between the transparent electrode 25 and the metal electrode 24 of each pixel circuit PX, thus forming the liquid crystal cell LC. The transparent electrode 25 is connected to a connection terminal 26 provided outside the display area 2 over the glass substrate 1, so that the AC square wave voltage Vcom is supplied through the film-like circuit board 23.

There are provided openings 27 at positions where the inside surface of the glass substrate 21 is superposed over the display electrodes 24. A shading layer is applied to the area other than the openings 27, thereby preventing light from being transmitted through the area other than the openings 27. If color filters, namely, red, green, and blue filters (not shown) are provided in the openings 27, it becomes possible for the image display device to display color images.

A polarizing plate 28 and a retardation plate 29 are bonded to the other surface of the glass substrate 21 remote from the glass substrate 1. The role of the polarizing plate 28 and the retardation plate 29 is to obtain a high light reflectance ratio between different AC voltage amplitudes VH and VL applied to the liquid crystal so that black or white is displayed.

Figure 6:
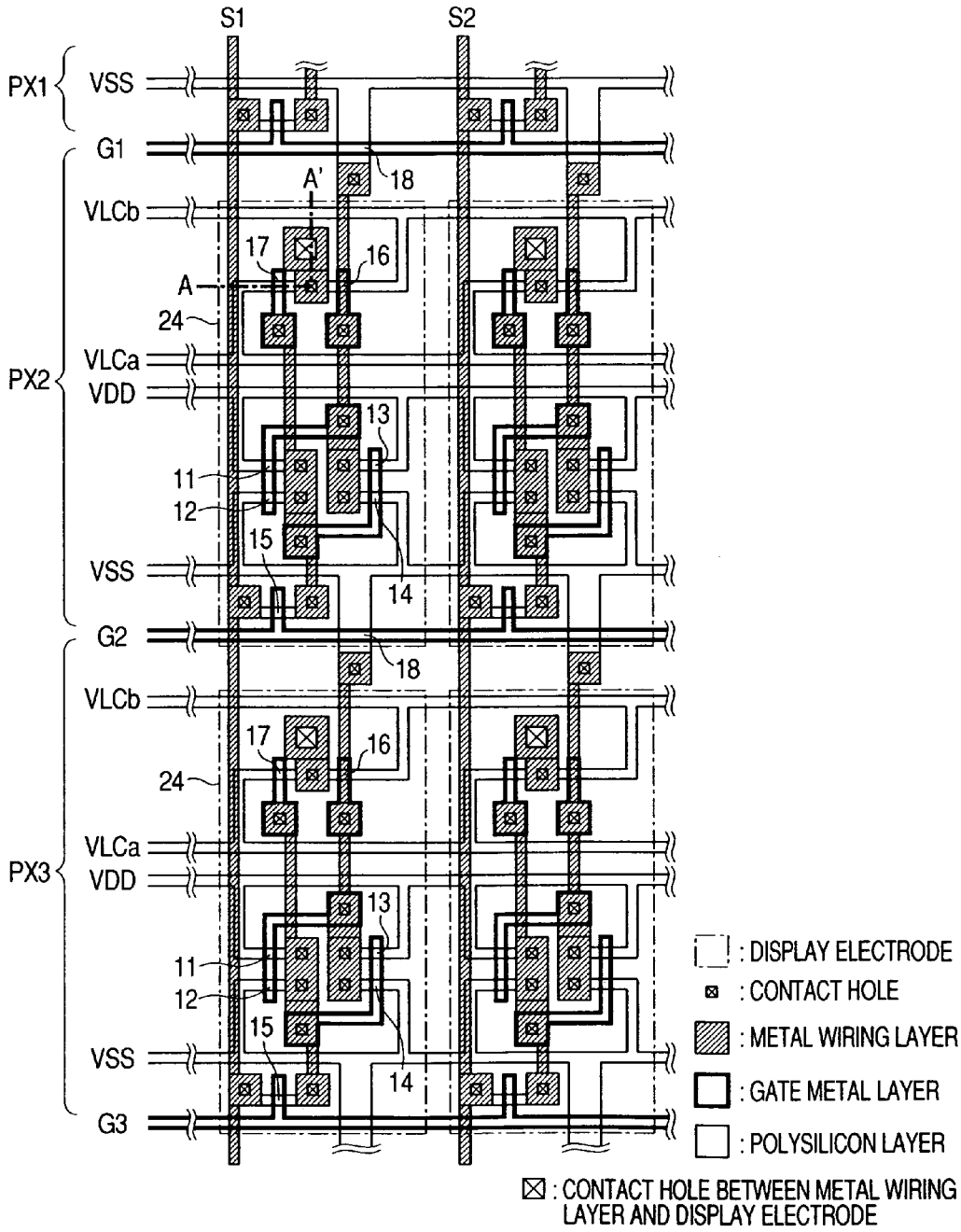
FIG. 6 is a front layout view of pixel circuits PX.

FIG. 6 shows an example of the layout of pixel circuits PX. In FIG. 6, there is shown the layout of about 2×2 pixel circuits in an area including the pixel circuits PX2 and PX3 shown in FIG. 1. The wirings of the voltages VDD, VSS, VLCa, and VLCb and the source and drain electrodes of transistors are formed by a polysilicon layer and connected in common with respect to a row of pixel circuits PX arranged in a horizontal direction. The gate lines G0 to G3 and the gate electrodes of transistors are formed by a gate metal layer. The data lines S1 to S2 and the remaining wiring are formed by a metal wiring layer.

The display electrode 24 is formed overlapping most components of the pixel circuit and is connected to the metal wiring layer through a contact hole. The TFTs 11 to 18 are formed by overlapping wiring of the gate metal layer with wiring of the polysilicon layer. Polysilicon layer portions that are adjacent to the TFTs 11 and 13 are doped with boron so that the TFTs 11 and 13 function as p-channel TFTs. Polysilicon layer portions that are adjacent to the TFTs 12 and 14 to 18 are doped with phosphorus so that the TFTs 12 and 14 to 18 function as n-channel TFTs.

The source electrode of the TFT 18 is connected to the power supply wiring VSS of an adjacent pixel circuit. For example, the TFT 18 constituting the pixel circuit PX3 is connected to the wiring that supplies the power supply voltage VSS to the TFTs 12 and 14 constituting the static memory in the pixel circuit PX2.

Figure 7:
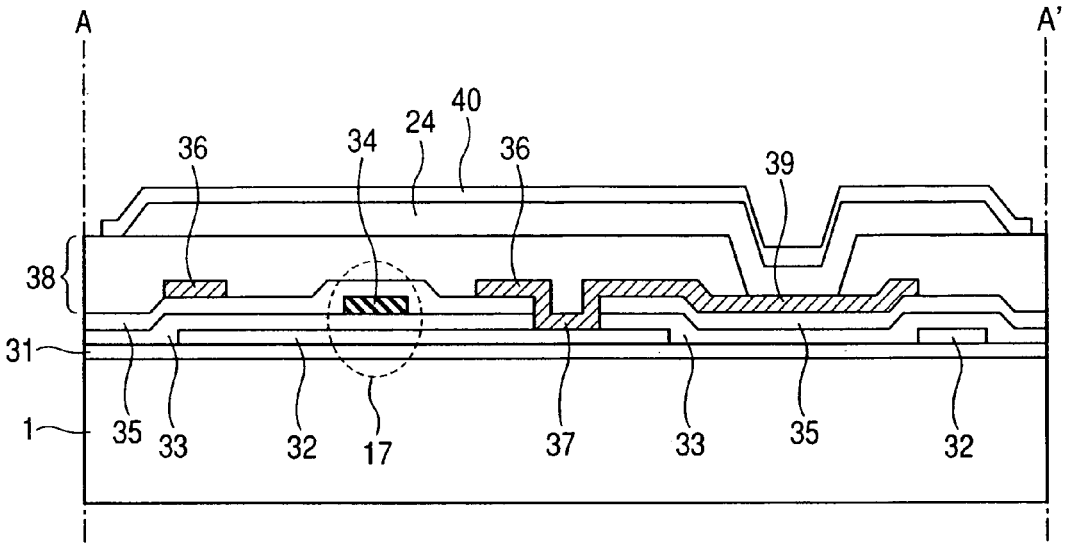
FIG. 7 is an illustration showing a cross section structure along line A-A' shown in FIG. 6.

FIG. 7 shows a cross section structure along the bold dotted line A-A' in FIG. 6. An insulating film 31 made of silicon oxide is formed on the glass substrate 1. A polysilicon layer 32 is formed thereon. Further, a gate metal layer 34 is formed thereover with a gate insulating film 33 made of silicon oxide between them.

The portion where the gate metal layer 34 overlaps the polysilicon layer 32 becomes the TFT 17. Further, a metal wiring layer 36 is formed thereover with an interlayer insulating film 35 made of silicon oxide between them. A contact hole 37 is bored through the gate insulating film 33 and the interlayer insulating film 35 so that the metal wiring layer 36 is connected to the polysilicon layer 32, or the metal wiring layer 36 is connected to the gate metal layer 34. Further, a display electrode 24 is formed thereover with a planarization insulating layer 38 between them. A contact hole 39 is bored through the planarization insulating layer 38 so that the display electrode 24 is connected to the metal wiring layer 36. In order to prevent corrosion, a transparent electrode 40 is overlapped and formed on the surface of the display electrode 24.

Figure 8:
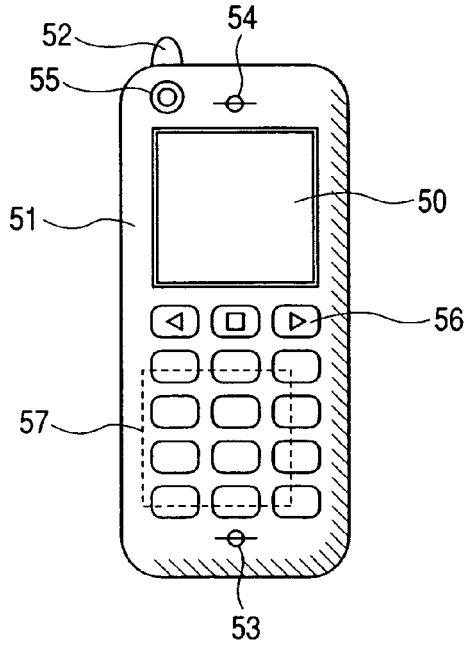
FIG. 8 is an illustration showing a mobile electronic device to which the image display device according to the invention applied.

FIG. 8 shows a mobile electronic device to which the image display device according to the invention applied. A mobile electronic device 51 is equipped with an antenna 52, a microphone 53, a speaker 54, an image sensor 55, and an audio playback button 56, as well as an image display device 50 according to the invention. Further, the mobile electronic device 51 incorporates a battery 57 for supplying power. The application of the image display device 50 according to the invention can reduce the power consumption of the mobile electronic device 51 and thereby prolong the operating time of the battery 57, or can reduce the size of the mobile electronic device 51 by downsizing the battery 57.

It should be understood by those skilled in the art that various modifications, combinations, sub-combinations and alterations may occur depending on design requirements and other factors insofar as they are within the scope of the appended claims or the equivalents thereof.

What is claimed is:

1. An image display device comprising:

a plurality of pixel circuits arranged in a matrix form over a substrate and each including at least one static memory;

a plurality of data lines to convey an image signal to the plurality of pixel circuits;

a plurality of gate lines, intersecting the data lines, to convey a scanning pulse to the plurality of pixel circuits; and a scanning circuit to sequentially supply the scanning pulse to the plurality of gate lines, wherein the at least one static memory includes a first inverter and a second inverter, each said inverter being comprised of an n-channel transistor and a p-channel transistor, an input portion of the first inverter being connected to an output portion of the second inverter, and an input portion of the second inverter being connected to an output portion of the first inverter, wherein each of the pixel circuits includes:

a first transistor to set a storing state of the static memory and a second transistor to reset a storing state of the static memory, a drain electrode of the first transistor is connected to the input portion of the first inverter, a drain electrode of the second transistor is connected to the input portion of the second inverter, a source electrode of the first transistor is connected to a corresponding one of the data lines, a gate electrode of the first transistor of a pixel circuit in a row of pixel circuits arranged parallel to the gate lines is connected to one gate line of the plurality of the gate lines, and a gate electrode of the second transistor of a pixel circuit in an adjacent row of pixel circuits is connected to the one gate line.

2. The image display device according to claim 1, wherein both the first and second transistors are of same polarity of an n-channel type or a p-channel type.

3. The image display device according to claim 1, wherein said transistors of the plurality of pixel circuits are polysilicon thin film transistors.

4. The image display device according to claim 1, wherein display electrodes connected to the plurality of pixel circuits are formed over the substrate and liquid crystal is held between each display electrode and a transparent substrate having a transparent electrode.

5. The image display device according to claim 1, wherein a source electrode of the second transistor is connected to wiring of a power source potential or a ground potential.

6. The image display device according to claim 5, wherein common power supply wiring formed of a polysilicon thin film is used as power supply wiring of the static memory.

7. The image display device according to claim 5, wherein power supply wiring of the static memory is connected to the source electrode of the second transistor.

* * * * *